US005221807A

United States Patent [19]

Vives

[11] Patent Number: 5,221,807

[45] Date of Patent: Jun. 22, 1993

[54] BALLISTIC PROTECTION ARMOR

[75] Inventor: Michel Vives, Eysines, France

[73] Assignee: Societe Europeenne de Propulsion, Suresnes, France

[21] Appl. No.: 621,783

[22] Filed: Dec. 4, 1990

[30] Foreign Application Priority Data

Dec. 6, 1989 [FR] France ..... 89 16137

[51] Int. Cl.[5] ..... F41H 5/04

[52] U.S. Cl. ..... 89/36.02; 89/36.11; 109/82

[58] Field of Search ..... 89/36.02, 36.01, 36.05, 89/36.11; 428/911; 109/80, 82, 83, 84

[56] References Cited

U.S. PATENT DOCUMENTS

| | | | |
|---|---|---|---|
| 3,523,057 | 8/1970 | Buck | 89/36.02 |
| 3,577,836 | 5/1971 | Tamura | 89/36.02 |
| 3,828,699 | 8/1974 | Bowen | 89/36.02 |
| 4,030,427 | 6/1977 | Goldstein | 89/36.02 |
| 4,879,165 | 11/1989 | Smith | 89/36.02 |

FOREIGN PATENT DOCUMENTS

| | | | |
|---|---|---|---|
| 209221 | 1/1987 | European Pat. Off. | 89/36.02 |
| 0213268 | 3/1987 | European Pat. Off. . | |
| 0237095 | 9/1987 | European Pat. Off. | 89/36.02 |
| 1952759 | 4/1970 | Fed. Rep. of Germany | 89/36.02 |
| 2658618 | 6/1978 | Fed. Rep. of Germany . | |
| 2703409 | 2/1987 | Fed. Rep. of Germany | 89/36.02 |
| 366869 | 10/1906 | France | 89/36.02 |
| 1396320 | 3/1965 | France | 89/36.02 |
| 2519133 | 7/1983 | France | 89/36.02 |
| 81882 | 9/1982 | Luxembourg . | |
| 127321 | 6/1919 | United Kingdom | 89/36.02 |
| 131640 | 9/1919 | United Kingdom . | |
| 89/08233 | 9/1989 | World Int. Prop. O. | 89/36.02 |

OTHER PUBLICATIONS

Merriam-Webster, Webster's Ninth New Collegiate Dictionary, 1985, p. 320.

English translation of French patent No. 1.396.320.

English translation of German patent No. 1952759.

*Primary Examiner*—Stephen M. Johnson

*Attorney, Agent, or Firm*—Weingarten, Schurgin, Gagnebin & Hayes

[57] ABSTRACT

The armor for providing ballistic protection comprises an armor plate for stopping projectiles with an auxiliary plate disposed in front thereof at a determined spacing therefrom, the auxiliary plate being constituted by a ceramic plate pierced by a large number of cells distributed in a regular mesh and constituted by blind holes extending perpendicularly to the rear face of the auxiliary plate and opening out into the front face thereof. The effect of the auxiliary plate is to destabilize and to score the projectiles so as to enhance their tendency to shatter on striking the armor plate.

19 Claims, 3 Drawing Sheets

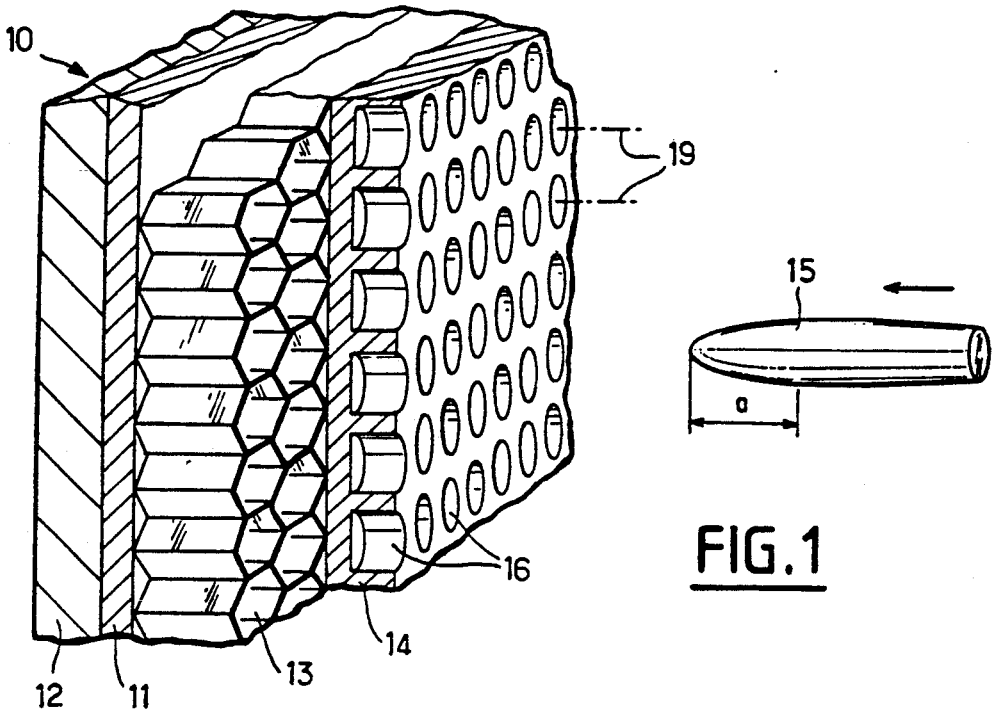
FIG. 1
FIG. 2
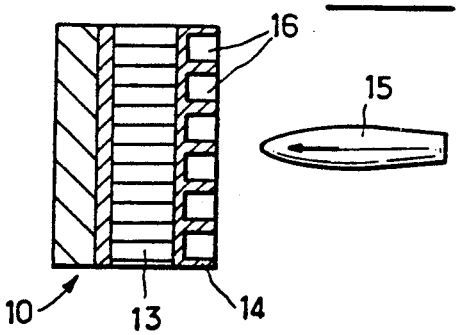
FIG. 3
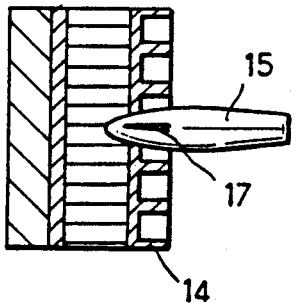
FIG. 4
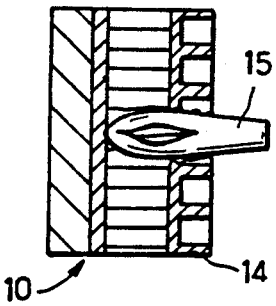
FIG. 5
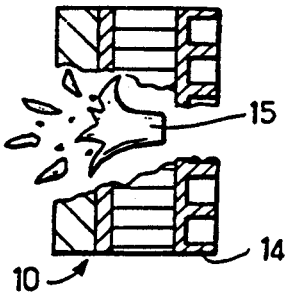

BALLISTIC PROTECTION ARMOR

The present invention relates to ballistic protection armor including an armor plate for stopping projectiles.

BACKGROUND OF THE INVENTION

Such an armor plate may be a metal plate, thereby providing armor which is cheap because the plate is itself low cost and is capable of being welded, and such armor is suitable for stopping projectiles having a velocity of less than 500 meters per second (m/s).

It is also possible to use a two-layer armor plate comprising a front part for ballistic protection, e.g. made of a ceramic, and a rear part for providing structural strength, e.g. made of Kevlar. Such a two-layer plate provides a saving in mass and gives good performance with projectiles at velocities greater than 500 m/s.

An object of the invention is to improve the ballistic performance of such armor, and in particular armor of the above-mentioned type using a two-layer plate.

SUMMARY OF THE INVENTION

To this end, the armor of the invention includes an auxiliary plate disposed in front of the armor plate at a determined spacing therefrom, and constituted by a ceramic plate pierced by a large number of cells distributed in a regular mesh and constituted by holes extending perpendicularly to the mean plane of the auxiliary plate. These holes may be blind holes opening out to the front face of the auxiliary plate, or else they may be through holes, in which case the rear face of the auxiliary plate should be covered with an isolating sheet, e.g. made of aluminum or of kevlar, for preserving the rear portions of the armor.

The effect of the auxiliary plate placed in front of the armor plate is to score the projectiles before they strike the armor plate, thereby providing lines of weakness preparing the projectiles for shattering when they strike the armor plate. In addition, projectiles are destabilized by the auxiliary plate and this assists in fragmenting them. This makes it possible to reduce the thickness and thus the mass per unit area of the armor plate, thereby obtaining an overall weight saving for equal effectiveness for a given armor assembly.

It is desirable to interpose an intermediate layer between the above-mentioned auxiliary plate and the armor plate, said intermediate layer determining the spacing between said two plates. This intermediate layer is preferably in the form of a honeycomb structure, or it may be in the form of a foam or of elastomer, and it has a shock-absorbing function.

The auxiliary plate may either be a sintered ceramic such as alumina, silicon carbide, or boron carbide, or else it may be a composite comprising a ceramic matrix containing fiber reinforcement. Such a ceramic matrix may be constituted by silicon or boron carbide and its fiber reinforcement may be constituted by carbon fibers or by silicon carbide fibers.

The walls of the cells in the auxiliary plate are preferably cylindrical or prismatic in shape having a diameter which is smaller than the caliber of the projectiles that are to be stopped by the armor. Where necessary, the front face of the auxiliary plate may include zones in relief which are uniformly spaced relative to the mesh constituted by the cells.

Lightweight armor of the invention is particularly suitable for protecting helicopters (seats, mechanical parts, and motor) and also for making bulletproof vests.

BRIEF DESCRIPTION OF THE DRAWINGS

Embodiments of the invention are described by way of example with reference to the accompanying drawings, in which:

FIG. 1 is a cross-section through a portion of armor of the invention;

FIGS. 2 to 5 show the stages whereby a projectile penetrating into the armor of FIG. 1 is destroyed;

DETAILED DESCRIPTION

Figure 6:
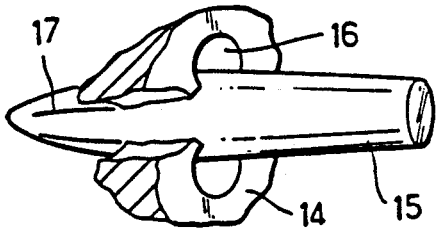
FIGS. 6 and 7 show the projectile of FIG. 3 shown respectively in a perspective side view and in cross-section.

FIG. 1 shows armor for providing protection against impact from projectiles 15 of conventional bullet shape, the armor comprising a main plate 10, an auxiliary plate 14, and an intermediate layer 13 defining the spacing between the plates 10 and 14. The auxiliary plate is made of a ceramic material and has two plane parallel faces. Its front face which receives the impact of projectiles 15 is pierced by circular section cells 16 which are constituted in the present example by blind holes that do not open out into its rear face. These cells which are cylindrical or possibly slightly conical in shape are distributed in rows and columns to perform a regular mesh over the front face. The axes 19 of the cells extend perpendicularly to the surface of the front face, and the cells are circular in section with a diameter that is smaller than the caliber of the projectiles 15 to be stopped.

Figure 7:
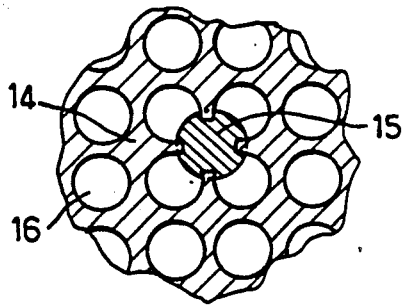

When a projectile 15 strikes the armor (FIG. 2) it initially encounters the auxiliary plates 14. Because of the cellular structure of the auxiliary plate on its projectile impact side, the brass jacket of the projectile 15 is split and torn and longitudinal grooves 17 are scored in its core by the broken walls of the cells (FIGS. 3, 6, and 7) penetrating therein by wedging. These grooves provide lines of weakness on the core of the projectile 15, thereby enhancing its tendency to shatter (FIG. 5) on striking the main plate 10 (FIG. 4) even if its velocity is then relatively low.

Figure 8:
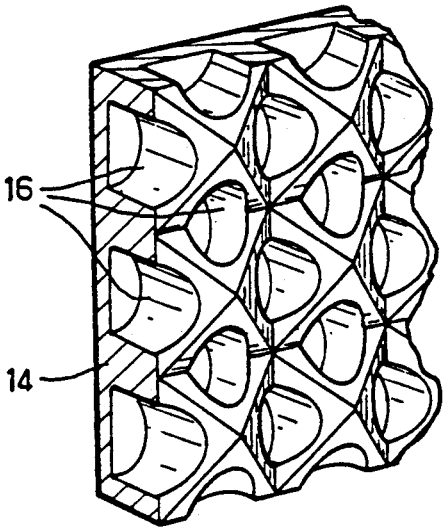
FIGS. 8 and 9 show two variant embodiments of the auxiliary plates included in the armor of FIG. 1 and FIGS. 10 and 11 show side sectional and front plan views respectively of an auxiliary plate having through holes closed by a sheet overlying the rear face thereof.
Figure 9:
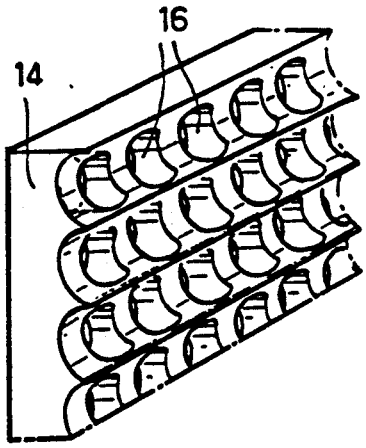

In a variant, instead of giving the front face of the auxiliary plate 14 a uniform and possibly plane shape, it may be given an irregular shape made up of zones in relief inclined at various different angles and in various different directions of slope. This shape may cause the projectile to ricochet, thereby increasing the effectiveness of the armor. For example, FIG. 8 shows a plate 14 whose front face is made up of regular square-based pyramids which are juxtaposed in rows and in columns, with the cells 16 being centered on the base edges of said pyramids. FIG. 9 shows another example in which the plate 14 has a front face made up of juxtaposed parallel fluting with the cells 16 being aligned in the depths thereof.

The cells 16 may be polygonal in outline, e.g. hexagonal. Such cell shapes may be chosen regardless of the structure adopted for the plate 14.

In general, the auxiliary plate 14 may be made of a sintered ceramic (alumina, silicon or boron carbide, etc.) or of a fiber and ceramic matrix composite (C/SiC, $C/B_4C$, SiC/SiC, etc.). The main plate 10 may comprise a single part 11 made of a ceramic matrix composite of one of the types mentioned above, or else it may comprise two parts 11 and 12 that are stuck together. With two such parts, the front part 11 may be made of sintered ceramic while the rear part 12 may be made of Kevlar, of ceramic matrix composite, or of steel, or alternatively the front part 11 may be made of a ceramic matrix composite with the rear part 12 then being made of steel, an alumina alloy, or Kevlar. The intermediate layer 13 is shown as having a honeycomb structure, and it may be made of aluminum, of Kevlar-epoxy, or of glass fiber-epoxy, having a thickness such that the spacing between the plates 10 and 14 is of the same order as the bullet-shaped tip of the projectiles 15 to be stopped.

Figure 10:
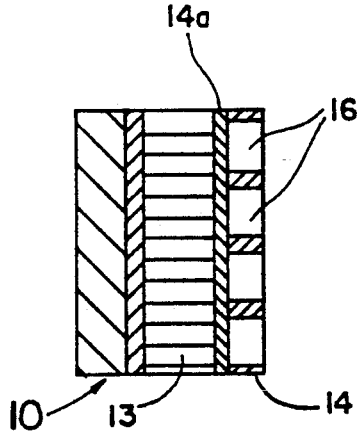
Figure 11:
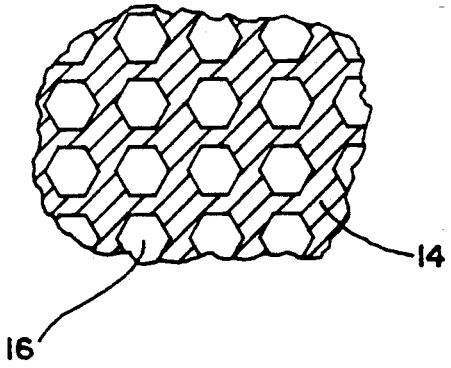

Alternatively, as illustrated in FIG. 10, the auxiliary plate 14 can be configured wherein the holes constituting the cells are through holes, closed by a sheet 14*a* overlying the rear face of the auxiliary plate 14.

I claim:

1. Ballistic protection armor including an armor plate for stopping projectiles, and further including an auxiliary plate disposed in front of the armor plate at a determined spacing therefrom, wherein said auxiliary plate is a ceramic plate pierced by a large number of cells distributed in a regular mesh and constituted by holes whose longitudinal axis extend perpendicularly to the mean plane of the auxiliary plate, and an intermediate layer interposed between said armor plate and said auxiliary plate, said intermediate layer having a honeycomb structure.

2. Armor according to claim 1, wherein the holes constituting the cells are through holes, closed by a sheet overlying the rear face of the auxiliary plate.

3. Armor according to claim 1, wherein the auxiliary plate is made of a sintered ceramic selected from a group consisting of alumina, silicon carbide, and boron carbide.

4. Armor according to claim 1, wherein the auxiliary plate is made of a composite comprising a ceramic matrix containing fiber reinforcement.

5. Armor according to claim 4, wherein the ceramic matrix is selected from a group consisting of silicon carbide and boron carbide.

6. Armor according to claim 4, wherein the fiber reinforcement is selected from a group consisting of carbon fibers and silicon fibers.

7. Armor according to claim 1, wherein the walls of the cells of the auxiliary plate are cylindrical in shape having a diameter which is smaller than the caliber of the projectiles that the armor is to stop.

8. Armor according to claim 1, wherein the front face of the auxiliary plate includes zones in relief which are regularly distributed relative to the mesh constituted by the cells.

9. Armor according to claim 1, wherein the holes forming the cells are blind holes opening out in the front face of the auxiliary plate.

10. Ballistic protection armor including an armor plate for stopping projectiles, and further including an auxiliary plate disposed in front of the armor plate at a determined spacing therefrom, wherein said auxiliary plate is a ceramic plate pierced by a large number of cells distributed in a regular mesh and constituted by blind holes opening out in the front face of the auxiliary plate, said blind holes having a longitudinal axis that extends perpendicularly to the mean plane of the auxiliary plate.

11. Armor according to claim 10, wherein the blind holes comprise through holes closed by a sheet overlying the rear face of the auxiliary plate.

12. Armor according to claim 10, wherein an intermediate layer is interposed between the auxiliary plate and the armor plate, the intermediate layer determining the spacing between the auxiliary plate and the armor plate.

13. Armor according to claim 12, wherein the intermediate layer has a honeycomb structure.

14. Armor according to claim 10, wherein the auxiliary plate is made of a sintered ceramic selected from a group consisting of alumina, silicon carbide, and boron carbide.

15. Armor according to claim 10, wherein the auxiliary plate is made of a composite comprising a ceramic matrix containing fiber reinforcement.

16. Armor according to claim 15, wherein the ceramic matrix is selected from a group consisting of silicon carbide and boron carbide.

17. Armor according to claim 15, wherein the fiber reinforcement is selected from a group consisting of carbon fibers and silicon fibers.

18. Armor according to claim 10, wherein the walls of the cells of the auxiliary plate are cylindrical in shape having a diameter which is smaller than the caliber of the projectiles that the armor is to stop.

19. Armor according to claim 10, wherein the front face of the auxiliary plate includes zones in relief which are regularly distributed relative to the mesh constituted by the cells.

* * * * *

UNITED STATES PATENT AND TRADEMARK OFFICE

CERTIFICATE OF CORRECTION

PATENT NO. : 5,221,807

DATED : June 22, 1993

INVENTOR(S) : Michel Vives

It is certified that error appears in the above-indentified patent and that said Letters Patent is hereby corrected as shown below:

In Column 1, lines 17 and 35, and in Column 3, lines 10, 13 and 15, "Kevlar" should read --(KEVLAR, a trademark of E.I. duPont de Nemours and Company)-- .

Signed and Sealed this

Twelfth Day of July, 1994

Bruce Lehman

*Attest:*

BRUCE LEHMAN

*Attesting Officer*

*Commissioner of Patents and Trademarks*